US006039438A

United States Patent [19]

Beerling

[11] Patent Number: 6,039,438

[45] Date of Patent: Mar. 21, 2000

[54] LIMITING PROPAGATION OF THIN FILM FAILURES IN AN INKJET PRINTHEAD

[75] Inventor: Tim Beerling, Corvallis, Oreg.

[73] Assignee: Hewlett-Packard Company, Palo Alto, Calif.

[21] Appl. No.: 08/955,193

[22] Filed: Oct. 21, 1997

[51] Int. Cl.[7] ..... B41J 2/05

[52] U.S. Cl. ..... 347/63; 347/67

[58] Field of Search ..... 347/63, 56, 65, 347/67, 87, 54, 20

[56] References Cited

U.S. PATENT DOCUMENTS

| | | | |
|---|---|---|---|
| 4,590,482 | 5/1986 | Hay et al. | 347/67 |
| 5,124,720 | 6/1992 | Schantz | 347/40 |
| 5,317,346 | 5/1994 | Garcia | 347/63 |
| 5,434,605 | 7/1995 | Osborne | 347/23 |
| 5,450,109 | 9/1995 | Hock | 347/63 |
| 5,479,197 | 12/1995 | Fujikawa et al. | 347/63 |
| 5,517,217 | 5/1996 | Haselby et al. | 347/23 |
| 5,872,583 | 2/1999 | Yamamoto et al. | 347/71 |

*Primary Examiner*—John Barlow
*Assistant Examiner*—Juanita Stephens

[57] ABSTRACT

A crack or delamination occurring within a thin film structure of a printhead is limited to a local region by strategically locating openings within the thin film structure. The etched openings serve to partially isolate each nozzle chamber. The openings are etched in passivation and other layers of the thin film to limit the propagation of the crack or delamination. As thermal stresses re-occur the crack or delamination extends. In may cases the crack or delamination eventually extends to the etched opening. The crack or delamination then ceases its propagation, in effect being blocked by the etched opening. By including an etched opening within the thin film near each nozzle chamber, a given nozzle chamber is isolated from a crack or delamination in the thin film at an adjacent or nearby nozzle. Reliability of a given nozzle therefore is less dependent upon the reliability of an adjacent nozzle.

20 Claims, 5 Drawing Sheets

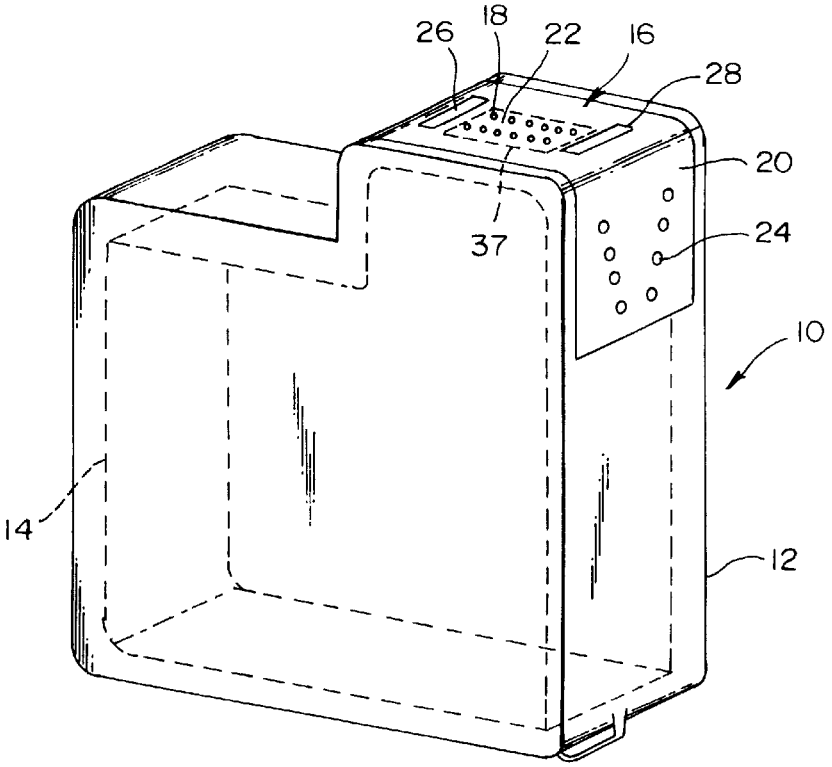
FIG. 1
FIG. 2
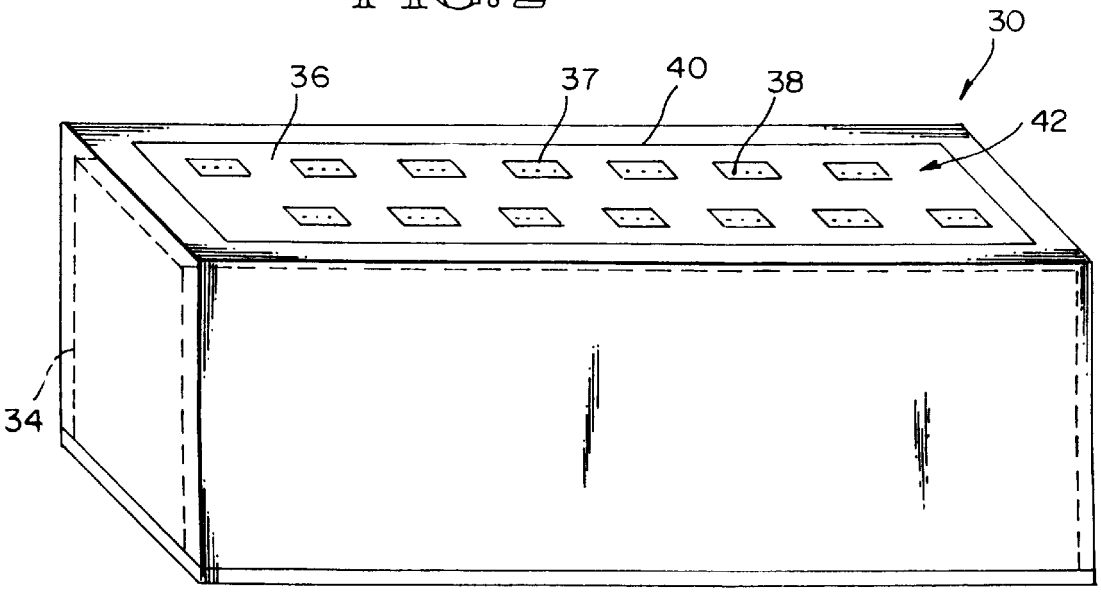

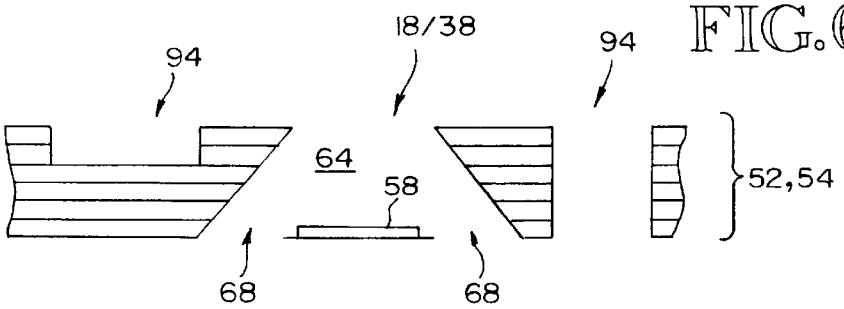
FIG. 6
FIG. 7
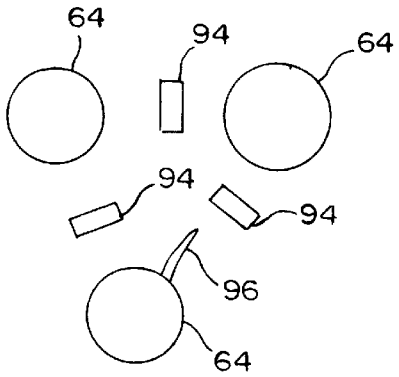
FIG. 8
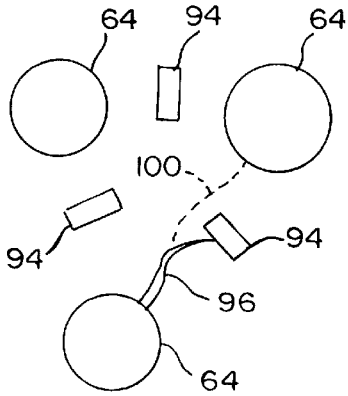
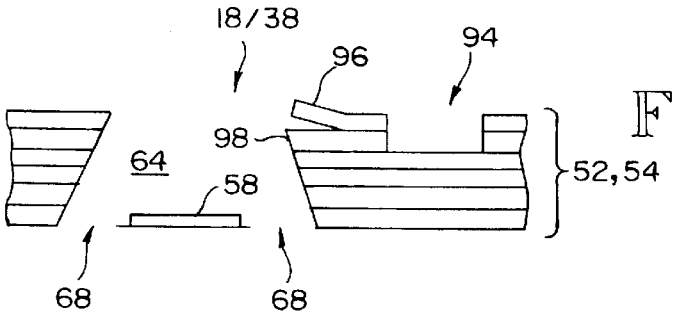
FIG. 9
FIG. 10
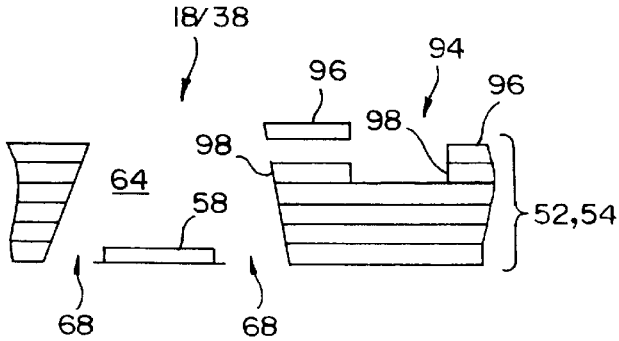

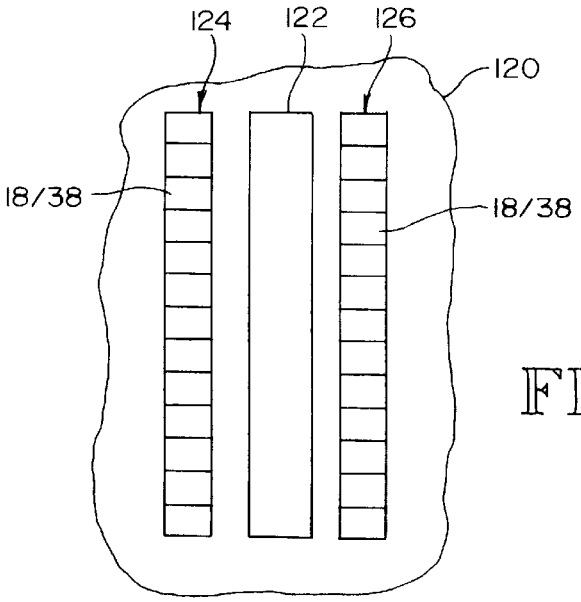
FIG. 11
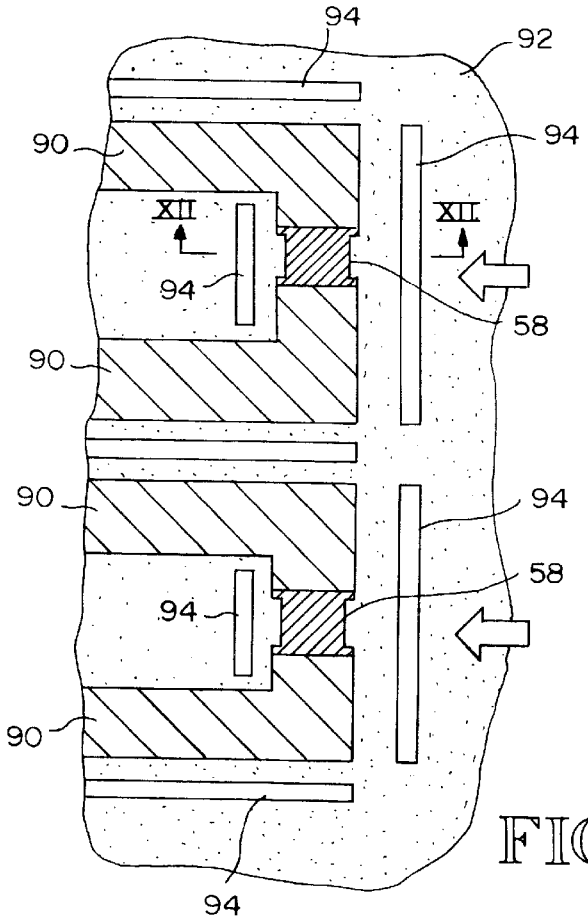
FIG. 12
FIG. 13
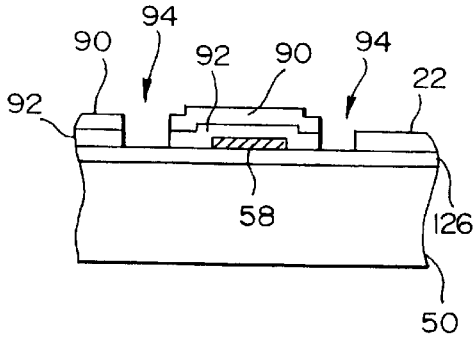

LIMITING PROPAGATION OF THIN FILM FAILURES IN AN INKJET PRINTHEAD

BACKGROUND OF THE INVENTION

This invention relates generally to inkjet printheads and methods for fabricating inkjet printheads, and more particularly, to methods for improving reliability and increasing useful life of an inkjet printhead.

There are known and available commercial printing devices such as computer printers, graphics plotters and facsimile machines which employ inkjet technology, such as an inkjet pen. An inkjet pen typically includes an ink reservoir and an array of inkjet printing elements. The array is formed by a printhead. Each printing element includes a nozzle chamber, a firing resistor and a nozzle opening. Ink is stored in the reservoir and passively loaded into respective firing chambers of the printhead via an ink refill channel and respective ink feed channels. Capillary action moves the ink from the reservoir through the refill channel and ink feed channels into the respective firing chambers. The printing elements are formed on a common substrate. Printer control circuitry outputs respective signals to the printing elements to activate a firing resistor. In response the firing resistor heats the ink causing an expanding vapor bubble to form. The bubble forces ink from the nozzle chamber out the nozzle opening. A nozzle plate adjacent to the barrier layer defines the nozzle openings. The geometry of the nozzle chamber, ink feed channel and nozzle opening defines how quickly a corresponding nozzle chamber is refilled after firing.

To achieve high quality printing ink drops or dots are accurately placed at desired locations at designed resolutions. It is known to print at resolutions of 300 dots per inch and 600 dots per inch. Higher resolutions also are being sought. One of the obstacles to achieving high quality printing with inkjet technology is failed, blocked or otherwise defective inkjet nozzles. In a thermal inkjet printhead one source of nozzle failure is thin film failure. In fabricating inkjet printheads, inkjet nozzles are formed on a silicon die from various layers of a thin film structure. The thin film structure is deposited on the die to define firing resistors, wiring lines and various passivation and insulation layers. The nozzle chambers and firing resistors define respective nozzles or printing elements. The thin film structure includes an array of printing elements with various areas between printing elements. During the printing cycle of a thermal inkjet printhead, local areas of the thin film are exposed to substantial changes in temperature due to the heating and cooling of the firing resistors. These changes in temperature cause severe thermal stresses on the thin film structure. As the printhead approaches the end of its useful life, it is expected that the thin film structure may crack or delaminate. For example, the top layer of the thin film structure typically is formed by a tough layer having a high hardness factor and a high ductility rating. This layer is exposed to high pressures from the collapsing bubble after ink ejection. Damage from continued exposure to such activity is referred to as cavitation damage.

Variations in the thermal coefficients of expansion of the thin film layers cause thermal stresses which may ultimately lead to delamination. It is failures such as this delamination which curtail a printhead's rated useful life. Another exemplary failure is cracking of a layer of the thin film structure. One or more adjacent resistors may fail from a crack or delamination of thin film layers. Further, with continued use of the printhead after a failure continued thermal stresses cause the crack to increase in length (i.e., propagate) or cause the delamination to increase in area (i.e., propagate). The result is a failure of additional nozzles.

SUMMARY OF THE INVENTION

Over time as thermal stresses and cavitation cause a failure (e.g., crack; delamination) in the thin film structure, such failure causes an inkjet nozzle to fail. In conventional inkjet printheads, the thermal stresses typically may cause the failure to occur at multiple nozzles. Over time such failure also increases in length or area and extends toward other inkjet nozzles. According to this invention, structures are included for making it more probable that the original failure is limited to a single nozzle and is prevented from extending to other nozzles.

According to the invention, the propagation of a failure in a thin film structure of an inkjet printhead is limited to a local region by etching non plugged openings within the thin film structure around a nozzle chamber through-opening. The etched openings serve to partially isolate the nozzle chamber from other nozzle chambers.

According to one aspect of the invention, openings are etched in the passivation and other layers of the thin film to limit the propagation of a crack or delamination in the thin film. During an initial failure, cracks and delamination can extend or spread. According to an aspect of this invention, the failure extends to the etched opening. The crack or delamination then ceases its propagation at the etched opening, in effect being blocked by the etched opening. By including multiple etched openings within the thin film around the nozzle chamber through-opening, the nozzle chamber is isolated from the failure in the thin film of an adjacent or nearby nozzle. Thus, in many instances a thin film failure at one nozzle does not spread to another nozzle. Further, the reliability of a given nozzle is less dependent upon the reliability of an adjacent nozzle.

Because the likelihood of failure of any given nozzle is more independent of failures of adjacent nozzles, nozzle redundancy schemes and print swath schemes become more effective strategies for increasing the useful life of a printhead. These schemes make use of nearby nozzles to compensate for a failed nozzle. The schemes become more effective because when a given nozzle fails, an adjacent nozzle is more likely to work for a longer time in place of the defective nozzle. When printing using a nozzle redundancy scheme, a nearby redundant nozzle is able to print the dot for the defective nozzle. Since the failure is less likely to spread to the redundant nozzle, the useful life of the printhead is significantly increased. For a printing swath scheme, multiple passes are used to print multiple layers of dots. For example, in one pass a given location receives a dot, then in a second pass the same location receives another dot. During the two passes, however, different nozzles print the overlaid dots. The two nozzles printing to the same location may be located near each other. If one nozzle fails, the location can still receive one dot from the other nozzle during the other pass. Because the reliability of the two nearby nozzles are more independent due to the etched openings of this invention, the printing swath method also becomes a more effective method for increasing the useful life of the printhead. The printing swath scheme is used for scanning type printheads. Nozzle redundancy schemes are used for either scanning or nonscanning printheads. Accordingly, the technique of including etched openings around nozzle through-openings is beneficial for scanning printheads and non-scanning printheads.

These and other aspects and advantages of the invention will be better understood by reference to the following detailed description taken in conjunction with the accompanying drawings.

BRIEF DESCRIPTION OF THE DRAWINGS

FIG. 1 is a perspective view of a scanning type inkjet pen having a printhead according to an embodiment of this invention;

FIG. 2 is a perspective view of a non-scanning type inkjet pen having a printhead according to an embodiment of this invention;

FIG. 6 is a diagram of a portion of the thin film structure for a printing element with etched openings adjacent to the printing element;

FIG. 7 is a diagram depicting a crack in the thin film structure;

FIG. 8 is a diagram depicting a crack in the thin film structure which has terminated at an etched opening;

FIG. 9 is a diagram depicting delamination of a layer of the thin film structure;

FIG. 10 is a diagram depicting delamination of a layer of the thin film structure where the delamination has terminated at an etched opening;

FIG. 11 is a partial plan view of a printhead according to an alternative embodiment of this invention;

FIG. 12 is plan view of the layout of multiple firing resistors with adjacent etched openings according to an embodiment of this invention; and FIG. 13 is a cross-sectional view of a resistor region of FIG. 12 taken along line XIII—XIII.

DESCRIPTION OF SPECIFIC EMBODIMENTS

Pen Embodiments

Figure 3:
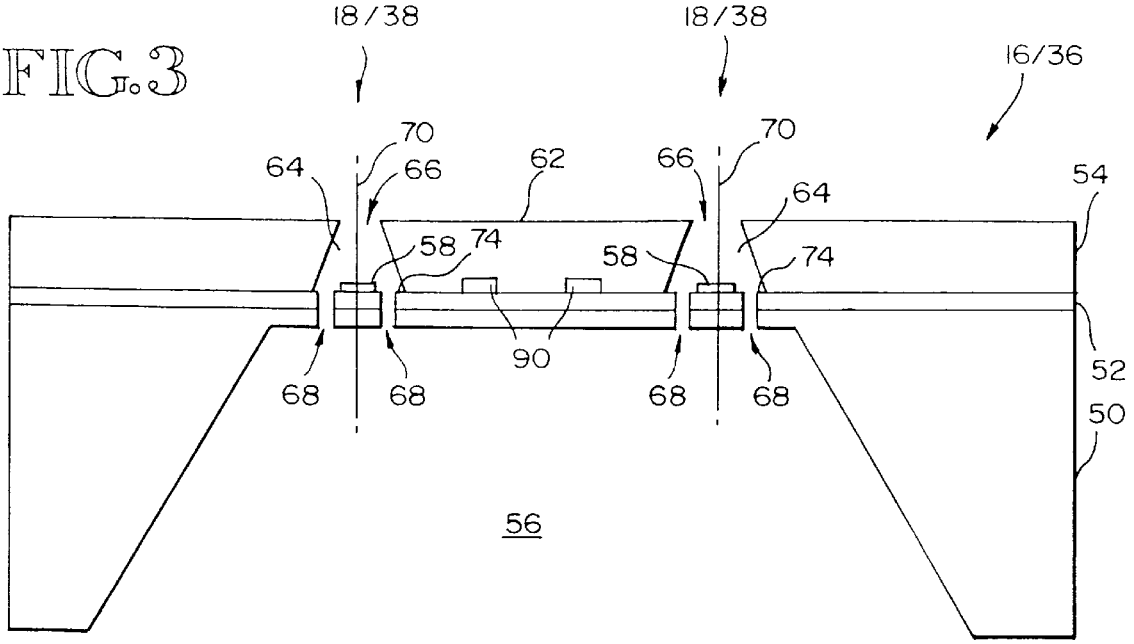
FIG. 3 is a partial cross-sectional view of the printhead of FIGS. 1 or 2 showing a pair of printing elements.

FIG. 1 shows scanning-type inkjet pen 10 according to an embodiment of this invention. The pen 10 moves relative to a media sheet during printing. The pen 10 is formed by a pen body 12, an internal reservoir 14 and a printhead 16. The pen body 12 serves as a housing for the reservoir 14. The reservoir 14 is for storing ink to be ejected from the printhead 16 onto a media sheet. The printhead 16 is formed by a die (not shown) and a flex circuit 20. The printhead 16 defines an array 22 of printing elements 18 (i.e., nozzle array). The nozzle array 22 is formed on the die. Ink is ejected from a nozzle 18 through an opening in the flex circuit toward a media sheet to form dots on the media sheet. The flex circuit includes conductive paths coupling printer control circuitry (not shown) to the nozzle array 22. The printer control circuitry is located apart from the pen. Contacts 24 occur on the flexible circuit 20 to couple to off-pen signal paths leading to the printer control circuitry. Windows 26, 28 within the flex circuit 20 facilitate mounting of the printhead 16 to the pen 10. During operation signals are received from the printer control circuitry and activate select nozzles to eject ink at specific times causing a pattern of dots to be output onto a media sheet. The pattern of dots forms a desired symbol, character or graphic.

FIG. 2 shows a wide-array non-scanning inkjet pen 30 according to another embodiment of this invention. In an exemplary embodiment the pen 30 extends at least a pagewidth in length (e.g., 5", 8.5", 11" or A4) and ejects ink droplets onto a media sheet. When installed in an inkjet printer, the pen 30 is fixed. The pen 30 includes a pen bar 32, an internal reservoir 34, and a printhead 36. The pen bar 32 is a housing for the reservoir 34 and supports the printhead 36. The pen bar 32 serves as a body to which the other components are attached. The reservoir 34 within the pen bar 32 stores ink to be ejected. In some embodiments the reservoir 34 serves as a resident reservoir connected to an external ink source located within the printer but separate from the pen 30. The printhead 36 is formed by one or more printhead substrates 37 and a flex circuit 40. The printhead 36 defines an array 42 of printing elements 38 (i.e., nozzle array 42). The nozzle array 42 is formed on the die(s). Ink is ejected from a printing element 38 through an opening in the flex circuit 42 toward a media sheet to form dots on the media sheet.

The flex circuit 40 is a printed circuit made of a flexible base material having multiple conductive paths and a peripheral connector. Conductive paths run from the peripheral connector to various nozzle groups and from nozzle group to nozzle group. In one embodiment the flex circuit 40 is formed from a base material made of polyamide or other flexible polymer material (e.g., polyester, polymethylmethacrylate) and conductive paths made of copper, gold or other conductive material. The flex circuit 40 with only the base material and conductive paths is available from the 3M Company of Minneapolis, Minn. The nozzle groups and peripheral connector then are added. The flex circuit 40 is coupled to off-circuit electronics via an edge connector or button connector.

During operation, the media sheet is fed adjacent to a printhead 36. As the media sheet moves relative to the printhead 32, ink droplets are ejected from printing elements 38 to form markings representing characters or images. The printhead 36 prints one or more lines of dots at a time across the pagewidth.

Printing Element Structure

FIG. 3 shows a portion of a printhead 16/36 for the pens 10/30 of FIGS. 1 or 2. The printhead 16/36 includes a silicon die 50, a structure 52 of one or more layers, and an orifice layer 54. The silicon die 50 provides rigidity and in effect serves as a chassis for other portions of the printhead 16/36. In some embodiments transistors also are formed in the silicon die 50. An ink refill channel 56 is formed in the die 50. In one embodiment the ink refill channel 56 is etched through a portion of the die 50 (e.g., for a center feed construction). In another embodiment ink refill channels are formed adjacent to two sides of the die (e.g., for edge feed construction).

In one embodiment the layer structure 52 is a thin film structure formed on the die 50. The thin film structure includes various passivation, insulation and conductive layers. Typically between 4 and 12 layers are included in a thin film structure. A firing resistor 58 and conductive traces 90 (see FIG. 5) are formed in the thin film structure for each printing element 18/38. In an alternative embodiment the firing resistors 58 and conductive traces 90 are formed in the die 50 and a barrier layer is added to define a nozzle chamber.

In one embodiment the orifice layer 54 is formed on the thin film structure 52 opposite die 50. In an alternative embodiment the orifice layer 54 is defined by the flexible circuit 20/40 (see FIGS. 1 and 2) and applied over the barrier layer. The orifice layer 54 has an exterior surface 62 which during operation faces a media sheet on which ink is to be printed. Nozzle chambers 64 and nozzle openings 66 are formed in the orifice layer 54.

Each printing element 18/38 includes a firing resistor 58, a nozzle chamber 64, a nozzle opening 66, and one or more feed channels 68. A center point of the firing resistor 58 defines a normal axis 70 about which components of the printing element 18/38 are aligned. Specifically it is preferred that the firing resistor 58 be centered within the nozzle chamber 64 and be aligned with the nozzle opening 66. The nozzle chamber 64 in one embodiment is frustoconical in shape. One or more feed channels 68 or vias are formed in the thin film structure 52 and die 50 to couple the nozzle chamber 64 to the refill channel 56. The feed channels 68 are encircled by the nozzle chamber lower periphery 74 so that the ink flowing through a given feed channel 68 is exclusively for a corresponding nozzle chamber 64.

In an exemplary embodiment, the die 50 is a silicon die approximately 675 microns thick. Glass or a stable polymer are used in place of the silicon in alternative embodiments. The thin film structure 52 is formed by one or more passivation or insulation layers formed by silicon dioxide, silicon carbide, silicon nitride, tantalum, poly silicon glass, or another suitable material. The thin film structure also includes a conductive layer for defining the firing resistor and for defining the conductive traces. In some embodiments the firing resistor is situatated directly on the silicon die 50. In other embodiments a passivation layer separates the firing resisotr from the die 50. The conductive layer is formed by tantalum, tantalum-aluminum or other metal or metal alloy. In an exemplary embodiment the thin film structure is approximately 3 microns thick. The orifice layer has a thickness of approximately 10 to 30 microns. The nozzle opening 66 has a diameter of approximately 10–30 microns. In an exemplary embodiment the firing resistor 58 is approximately square with a length on each side of approximately 10–30 microns. The base surface 74 of the nozzle chamber 64 supporting the firing resistor 58 has a diameter approximately twice the length of the resistor 58. Although exemplary dimensions and angles are given such dimensions and angles mary vary for alternative embodiments.

In operation ink fills the refill channel 56, the feed channels 68 and the firing chambers 64. The ink forms a meniscus bulging into the nozzle opening 66. The firing resistor 58 is connected by an electrically wiring line 90 (see FIG. 5) to a current source. The current source is under the control of a processing unit (not shown), and sends current pulses to select firing resistors 58. An activated firing resistor 58 causes an expanding vapor bubble to form in the firing chamber 64 forcing such ink out through the nozzle opening 66. The result is a droplet of ink ejected onto a media sheet at a specific location. Such droplet, as appearing on the media sheet, is referred to as a dot. Conventionally, characters, symbols and graphics are formed on a media sheet at a resolution of 300 dots per inch or 600 dots per inch. Higher resolutions also are possible.

Printhead Embodiments

Figure 4:
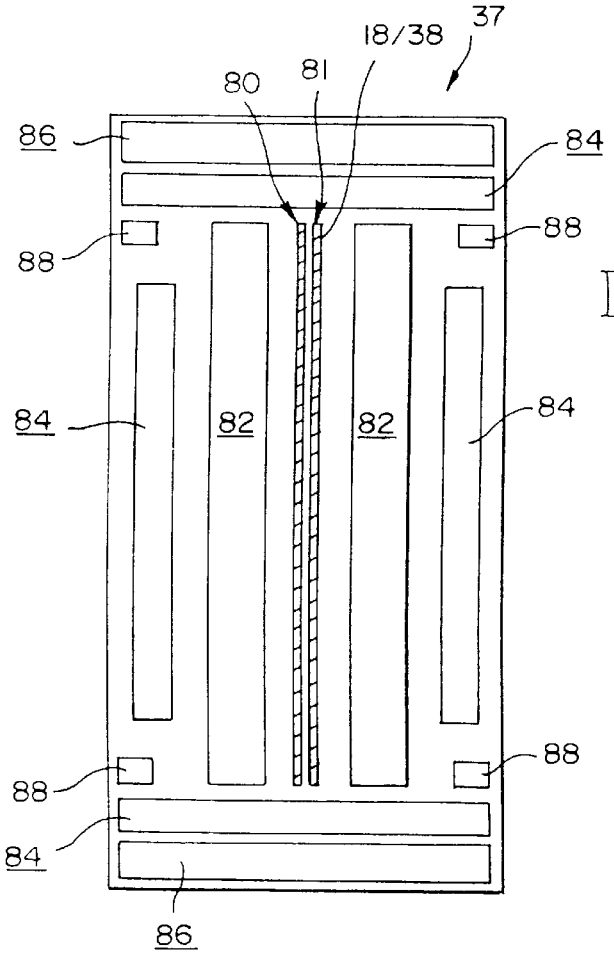
FIG. 4 is a plan view of a printhead substrate of FIGS. 1 or FIG. 2.

FIG. 4 shows a printhead substrate 37 having two columns 80, 81 of printing elements 18/38. The printhead substrate is the printhead 16 of FIG. 1 and is all or a portion of the printhead 38 of FIG. 2. In alternative embodiments additional columns are included. Such additional columns are either normally operating printing elements or are redundant printing elements used in place of a printing element in the columns 80, 81. The printhead illustrated is representative of either a scanning type printhead or a non-scanning wide-array printhead. A non-scanning wide-array printhead typically has more nozzles per column. In an alternative embodiment, a nonscanning wide-array printhead is formed by aligning a plurality of smaller printheads on a substrate. The printhead illustrated is a center feed printhead having an ink slot away from the edges of the printhead substrate. In alternative embodiments the ink refill slot is located toward an edge of the printhead substrate.

Associated with each printing element 18/38 is a driver for generating the current level to achieve the desired power levels for heating the element's firing resistor. Also included is logic circuitry for selecting which printing element is active at a given time. Driver arrays 82 and logic 84 are depicted in block format. The firing resistor of a given printing element is connected to a driver by a wiring line (see FIG. 5). Also included in the printhead 16/36 are contacts pad arrays 86 for electrically coupling the integrated portion of the printhead to a flex circuit or to off-pen circuitry. In addition circuitry 88 is included for detecting nozzle failures.

Nozzle out detection circuitry includes an illumination source, an illumination detector a pre-amplifier, and an autotracking pulse detector. Additional detail for such circuitry is described in commonly-assigned U.S. Pat. No. 5,517,217 issued May 14, 1996 for "Apparatus for Enhancing Ink-flow Reliability in a Thermal-Inkjet Pen; Method for Priming and Using Such a Pen."

Figure 5:
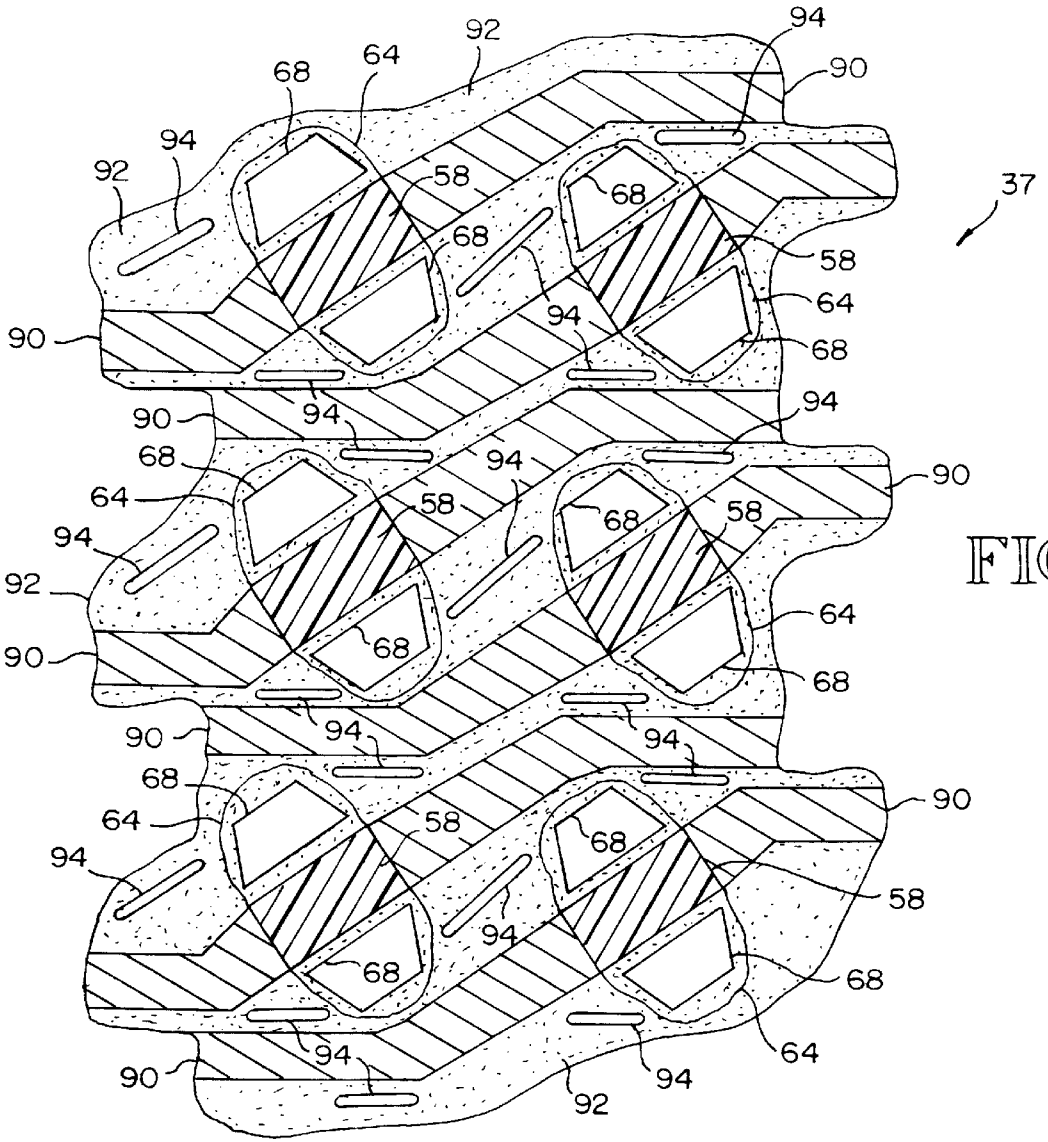
FIG. 5 is a plan view of the layout of multiple printing elements showing multiple layers of a thin film structure with etched openings according to an embodiment of this invention.

FIG. 5 shows a layout of firing resistors 58 for a portion of the printhead 16/36. The layout represents multiple layers of the thin film structure. A given nozzle chamber 64 encompasses the area of a firing resistor 58 and the pair of adjacent feed channel openings 68. The components shown in FIG. 5 represent layers of the thin film structure 52. The firing resistors 58 represent one layer of thin film structure 52. The wiring lines 90 represent another layer of the thin film structure 52. The wiring lines 90 and firing resistors 58 of a given printing element are in electrical communication. The firing resistors 58 and wiring lines 90 are formed of conductive materials. Other layers of the thin film structure include passivation or insulation layers depicted by number 92. The passivation layers are formed by silicon dioxide, silicon carbide, silicon nitride, tantalum, poly silicon glass, or another suitable material.

According to an aspect of this invention, respective openings 94 are etched in one or more passivation or insulation layers 92 in areas between firing chambers 64 of respective printing elements 18/38. In an exemplary embodiment there ore four openings 94 extending away from each nozzle chamber 64, although the number, direction and orientation of the openings 94 may vary. In the embodiment illustrated each opening is a narrow elongated opening having one end region near a nozzle chamber (but not intersecting onto a nozzle chamber). The other end of the opening 94 is near another nozzle chamber or a wiring line. According to a preferred embodiment the etched openings 94 do not intersect a nozzle chamber and do not extend through a wiring line layer or firing resistor layer. The openings 94 extend through at least one layer of the thin film structure 52, and may extend through all layers in the structure 52 as shown in FIG. 6.

Over time as thermal stresses cause a failure (e.g., crack; delamination) in the thin film structure, such failure causes an inkjet nozzle to fail. In conventional inkjet printheads, the thermal stresses cause the failure to occur at perhaps multiple nozzles. Over time, such failure even increases in length or area and extends toward other inkjet nozzles. As a result additional nozzles also begin to fail. It is desirable, however, to limit the effect of a thin film failure to the local region of the failure. More specifically, it is desirable to limit the effect of a thin film failure to a single nozzle. The etched openings serve to partially isolate the nozzle chamber of a given printing element from the nozzle chamber of adjacent printing elements. Thus, the original failure occurs only at one nozzle and is blocked from expanding to other nozzles.

The openings 94 are etched in the passivation and other layers of the thin film 52 to limit the propagation of a crack or delamination in the thin film. FIG. 7 shows a portion of the thin film structure 52 with a crack 96. As thermal stresses reoccur the length of the crack extends. In some cases the failure eventually extends to the etched opening 94 as shown in FIG. 8. The crack then ceases its propagation, in effect being blocked by the etched opening. Dotted line 100 shows where the crack would have propagated to if the openings 94 were not present. Note that the crack would have reached an additional nozzle chamber 64 causing failure of another printing element 18/38.

FIG. 9 shows a portion of the thin film structure 52 with the top layer 96 delaminated from the next layer 98. As thermal stresses re-occur the area of the delamination increases. In many cases the failure eventually extends to the etched opening 94 as shown in FIG. 10 The delamination crack then ceases its propagation, in effect being blocked by the etched opening 94. By including multiple etched openings 94 within the thin film 52 around the nozzle chamber 64 through-opening, the nozzle chamber is isolated from the failure in the thin film of an adjacent or nearby nozzle. Thus, in many instances a thin film failure at one nozzle does not spread to another nozzle. Further, the reliability of a given nozzle is less dependent upon the reliability of an adjacent nozzle.

FIG. 11 shows an alternative embodiment for an inkjet printhead 120 having redundant printing elements 18/38 in multiple rows 124, 126. The printhead 120 includes a center feed slot 122 which feeds ink to redundant rows of printing elements 18/38. FIG. 12 shows a layout of firing resistors 58 with wiring lines 90 for a portion of the printhead 120. According to an aspect of this invention, respective openings 94 are etched in one or more passivation or insulation layers 92 in areas adjacent to firing resistors 58 (see FIG. 13). As shown in FIG. 13, underlying each firing resistor 58 is a dielectric layer 126 and the silicon die 50. Over the firing resistor 58 is a passivation layer 92 and a conductive layer defining the wiring lines 90. Adjacent to the firing resistor are the openings 94. According to a preferred embodiment the etched openings 94 of nozzle array 22 do not intersect a nozzle chamber and do not extend through a wiring line layer or firing resistor layer. The openings 94 extend through at least one layer of the layer structure 52.

Exemplary Printing Methods

Because the likelihood of failure of any given printing element 18/38 nozzle is more independent of failures of adjacent elements, redundancy schemes and print swath schemes become more effective strategies for increasing the useful life of a printhead. These schemes make use of nearby nozzles to compensate for a failed nozzle. The schemes become more effective because when a given nozzle fails, an adjacent nozzle is more likely to work for a longer time to print for the defective nozzle. When printing using a nozzle redundancy scheme, a nearby redundant nozzle is able to print the dot for the defective nozzle. Since the failure is less likely to spread to the redundant nozzle, the useful life of the printhead is significantly increased.

For a printing swath scheme, multiple passes are used to print multiple layers of dots. For example in one pass a given location receives a dot, then in a second pass the same location receives another dot. During the two passes, however, different nozzles print the overlaid dots. The two nozzles printing to the same location may be located near each other. If one nozzle fails, the location can still receive one dot from the other nozzle during the other pass. Because the reliability of the two nearby nozzles are more independent due to the etched openings of this invention, the printing swath method also becomes a more effective method for increasing the useful life of the printhead. The printing swath scheme is used for scanning type printheads. Nozzle redundancy schemes are used for either scanning or nonscanning printheads. Accordingly, the technique of including etched openings around nozzle through-openings is beneficial for scanning printheads and non-scanning printheads.

U.S. Pat. No. 6,163,882 of Hickman commonly assigned to the assignee of the present invention filed Dec. 27, 1988 for "Printing of Pixel Locations by an Inkjet Printer Using Multiple Nozzles for Each Pixel or Pixel Row" describes one printing method that's effectiveness is increased by this invention. Dot-on-dot and Double-dot-always techniques are disclosed for printing multiple ink dots on a single pixel from either the same nozzle or from two different nozzles. Commonly-assigned U.S. patent application Ser. No. 08/277,723 filed Jul. 20, 1994 of David E. Hackleman for "Redundant Nozzle Dot Matrix Printheads and Methods of Use" describes a printing swath methodology that's effectiveness also is improved by this invention.

Although preferred embodiments of the invention has been illustrated and described, various alternatives, modifications and equivalents may be used. For example, in alternative embodiments components of the nozzle out detection circuitry 88 are located within the openings 94. In addition, although center feed inkjet printheads have been illustrated, other feed orientations, such as an edge feed architecture also are encompassed by the invention. Therefore, the foregoing description should not be taken as limiting the scope of the inventions which are defined by the appended claims.

What is claimed is:

1. An inkjet pen for ejecting ink droplets onto a print medium, said pen comprising:

an inkjet printhead and a surface to which the inkjet printhead is coupled;

the inkjet printhead comprising a substrate and a plurality of layers and having a plurality of printing elements formed in the plurality of layers, the plurality of layers overlaying the substrate, wherein each one printing element of said plurality of printing elements comprises:

(a) a resistive element for heating ink to generate said ink droplets, the resistive element formed in a conductive layer of said plurality of layers;

(b) a firing chamber having a base supporting said resistive element, the firing chamber defined by a chamber wall, the wall formed by one or more layers of said plurality of layers;

(c) an ink feed channel for supplying ink to said firing chamber through a firing chamber entrance; and (d) a nozzle in communication with the firing chamber through which ink droplets are ejected, the nozzle having a nozzle opening occurring in at least an outermost layer of the plurality of layers, said outermost layer being furthest of the plurality of layers from the substrate;

wherein said nozzle opening from respective ones of said plurality of printing elements together form a plurality of nozzle openings, wherein respective non-plugged openings are formed in at least said outermost layer of said plurality of layers in regions of the printhead between respective nozzle openings of said plurality of nozzle openings.

2. The pen of claim 1, in which each respective non-plugged opening is operatively located to limit delamination among said plurality of layers in an area proximal to said respective non-plugged opening and an adjacent printing element firing chamber, the respective non-plugged opening serving to terminate propagation of said delamination.

3. The pen of claim 1, in which each respective non-plugged opening is operatively located to limit propagation of a crack within said one or more layers forming said respective non-plugged opening for a crack which occurs in an area proximal to said respective non-plugged opening and an adjacent printing element firing chamber, the respective non-plugged opening serving to terminate propagation of said crack, wherein said crack propagates toward the respective non-plugged opening in response to thermal stresses occurring during operation of the printhead.

4. The pen of claim 1, in which a plurality of the respective non-plugged openings extend through all layers of said plurality of layers.

5. The pen of claim 1, in which a plurality of the respective non-plugged openings extend through less than all layers of said plurality of layers.

6. The pen of claim 1, in which the plurality of layers includes a first layer closest to the substrate and two or more layers furthest from the substrate, and wherein a plurality of the respective non-plugged openings extend through said two or more layers furthest from the substrate.

7. The pen of claim 6, in which each respective non-plugged opening is operatively located to limit delamination among said two or more layers furthest from the substrate in an area proximal to said respective non-plugged opening and an adjacent printing element firing chamber, the respective non-plugged opening serving to terminate propagation of said delamination.

8. An inkjet printhead for ejecting ink droplets onto a print medium, comprising:

a substrate, a plurality of layers, and a plurality of printing elements, wherein the plurality of layers overlay the substrate, wherein the plurality of printing elements are formed in the plurality of layers, and wherein each one of a multiple of said plurality of printing elements comprises:

(a) a resistive element for heating ink to generate said ink droplets, the resistive element formed in a conductive layer of said plurality of layers;

(b) a firing chamber having a base supporting said resistive element, the firing chamber defined by a chamber wall, the wall formed by one or more layers of said plurality of layers;

(c) an ink feed channel for supplying ink to said firing chamber through a firing chamber entrance; and (d) a nozzle in communication with the firing chamber through which ink droplets are ejected, the nozzle having a nozzle opening occurring in at least an outermost layer of the plurality of layers, said outermost layer being furthest of the plurality of layers from the substrate;

wherein said nozzle opening from respective ones of said plurality of printing elements together form a plurality of nozzle openings, wherein respective non-plugged openings are formed in at least said outermost layer of said plurality of layers in regions of the printhead between respective nozzle openings of said plurality of nozzle openings.

9. The printhead of claim 8, in which each respective non-plugged opening is operatively located to limit delamination among said plurality of layers in an area proximal to said respective non-plugged opening and an adjacent printing element firing chamber, the respective non-plugged opening serving to terminate propagation of said delamination.

10. The printhead of claim 8, in which each respective non-plugged opening is operatively located to limit propagation of a crack within said one or more layers forming said respective non-plugged opening for a crack which occurs in an area proximal to said respective non-plugged opening and an adjacent printing element firing chamber, the respective non-plugged opening serving to terminate propagation of said crack, wherein said crack propagates toward the respective non-plugged opening in response to thermal stresses occurring during operation of the printhead.

11. The printhead of claim 8, in which a plurality of the respective non-plugged openings extend through all layers of said plurality of layers.

12. The printhead of claim 8, in which a plurality of the respective non-plugged openings extend through less than all layers of said plurality of layers.

13. The printhead of claim 8, in which the plurality of layers includes a first layer closest to the substrate and two or more layers furthest from the substrate, and wherein a plurality of the respective non-plugged openings extend through said two or more layers furthest from the substrate.

14. The printhead of claim 13, in which each respective non-plugged opening is operatively located to limit delamination among said two or more layers furthest from the substrate in an area proximal to said respective non-plugged opening and an adjacent printing element firing chamber, the respective non-plugged opening serving to terminate propagation of said delamination.

15. A method of fabricating an inkjet printhead for ejecting ink droplets onto a print medium, comprising the steps of:

applying a plurality of layers to a substrate;

forming a plurality of printing elements in said plurality of layers, each printing element extending through a multiple of said plurality of layers, each one of said plurality of printing elements having a resistive element for heating ink to generate said ink droplets, the resistive element formed in a conductive layer of said plurality of layers, each one of said printing elements having a nozzle opening in an outermost layer of said plurality of layers through which said ink droplets are ejected, each one of said plurality of printing elements having a firing chamber which has a base supporting said resistive element, the firing chamber defined by a chamber wall, the wall formed by one or more other layers of said plurality of layers;

wherein said nozzle opening from each one of said plurality of printing elements together form a plurality of nozzle openings; and forming respective non-plugged openings in at least said outermost layer of said plurality of layers in regions of the printhead between respective nozzle openings of said plurality of nozzle openings.

16. The method of claim 15, in which each respective non-plugged opening is operatively located to limit delamination among said plurality of layers in an area proximal to said respective opening and an adjacent printing element firing chamber, the respective non-plugged opening serving to terminate propagation of said delamination.

17. The method of claim 15, in which each respective non-plugged opening is operatively located to limit propagation of a crack within said one or more layers forming said respective non-plugged opening for a crack which occurs in an area proximal to said respective non-plugged opening and an adjacent printing element firing chamber, the respective non-plugged opening serving to terminate propagation of said crack, wherein said crack propagates toward the respective non-plugged opening in response to thermal stresses occurring during operation of the printhead.

18. The method of claim 15, in which a plurality of the respective non-plugged openings extend through all layers of said plurality of layers.

19. The method of claim 15, in which the plurality of layers includes a first layer closest to the substrate and two or more layers furthest from the substrate, and wherein a plurality of the respective non-plugged openings extend through said two or more layers furthest from the substrate.

20. The method of claim 19, in which each respective non-plugged opening is operatively located to limit delamination among said two or more layers furthest from the substrate in an area proximal to said respective non-plugged opening and an adjacent printing element firing chamber, the respective non-plugged opening serving to terminate propagation of said delamination.

* * * * *